US006553916B2

(12) United States Patent
Goldbeck

(10) Patent No.: US 6,553,916 B2
(45) Date of Patent: Apr. 29, 2003

(54) CAR SPOTTER DRIVE

(75) Inventor: Bradley J. Goldbeck, Montrose, MN (US)

(73) Assignee: Calbrandt, Inc., Delano, MN (US)

( * ) Notice: Subject to any disclaimer, the term of this patent is extended or adjusted under 35 U.S.C. 154(b) by 0 days.

(21) Appl. No.: 09/905,057

(22) Filed: Jul. 12, 2001

(65) Prior Publication Data

US 2003/0010249 A1 Jan. 16, 2003

(51) Int. Cl.[7] ..... B61B 13/00

(52) U.S. Cl. ..... 104/162; 104/172.3; 104/172.5; 104/172.1

(58) Field of Search ..... 104/26.1, 165, 104/162, 163, 169, 172.1, 172.3, 172.4, 172.5, 173.1, 178

(56) References Cited

U.S. PATENT DOCUMENTS 3,154,023 A * 10/1964 Karlet et al. ..... 104/162
3,169,490 A * 2/1965 Saxonmeyer ..... 104/162
3,556,011 A * 1/1971 Saxonmeyer ..... 104/162
4,006,691 A 2/1977 Kacir et al.
4,354,792 A 10/1982 Cornish
4,392,575 A 7/1983 Baker et al.
4,487,547 A 12/1984 Cornish et al.
4,512,260 A 4/1985 Manning, Jr. et al.
4,926,755 A * 5/1990 Seiford, Sr. ..... 104/162
5,042,642 A * 8/1991 Ullrich ..... 318/138
5,150,656 A 9/1992 Lobb et al.
5,174,212 A 12/1992 Judy
5,709,153 A 1/1998 Brandt

* cited by examiner

*Primary Examiner*—Mark T. Le
(74) *Attorney, Agent, or Firm*—C. G. Mersereau; Nikolai & Mersereau, P.A.

(57) ABSTRACT

The present invention provides a low clearance, compact guideway, train positioning system that can be installed in close quarters alongside an existing railroad track. The system is chain driven and features an improved over/under or vertical sprocket carriage drive system in which parts normally exposed to the elements are protected while, at the same time, horizontal space requirements alongside the track are reduced. The system employs a vertically oriented chain drive which employs enclosed vertically mounted drive and idler sprocket units and a chain tube enclosing the lower chain strand which further minimizes exposure of the mechanism chain to the elements by totally enclosing the lower chain path in the over/under arrangement.

10 Claims, 6 Drawing Sheets

CAR SPOTTER DRIVE

BACKGROUND OF THE INVENTION

I. Field of the Invention

The present invention relates generally to train handling equipment and particularly to car spotting systems for indexing a coupled string or trip of cars through a work station, one or more cars at a time during loading or unloading operations. More specifically, the present invention is directed to providing a more compact drive system that includes additional protection for moving parts. The system employs a chain drive with aligned, vertically disposed drive and idler sprockets which minimize required horizontal space and exposure of drive elements.

II. Related Art

Trains, many containing 100 or more cars of identical or a variety of sizes, have long been acknowledged as desirable and efficient carriers of bulk raw materials such as coal, iron ore, limestone, various finely divided dry bulk agricultural products including grains, etc., and liquid or dry chemicals. These cars are typically filled from above and may be emptied using a rotary car dumper in the case of coal or iron ore. However, gas or liquid filled tank cars or those hauling agricultural products are bottom emptied into stationary material receiving or freight handling equipment such as pipelines, tanks, chutes, conveyor handlers or the like. The cars may be provided with a discharge tube and drain valves or a number of spaced bottom discharging hopper bins or chutes accessing the main storage volume of the car enclosed by sliding discharge gates. These are designed to be precisely positioned at dedicated receiving facilities situated at fixed stations such as grain or coal bins and conveyors positioned beneath the railroad track. Liquid bulk cargo is typically unloaded by connecting outlets to large hoses with associated pumping equipment and opening bottom drain valves. The cargo then being pumped into tanks or tank trucks located near the tracks.

In the discharge operation, a connected train engine roughly positions one end of a string of cars to be unloaded close to the unloading facility. Because train engines are not well suited for indexing or precisely positioning individual cars or sets of cars along the track, train positioning devices or car spotting devices, also known as railroad car progressors or indexers, have been built and operated at fixed stations.

Railroad car indexers of the class of interest include at least one car engaging and propelling strut member or "dog" for engaging at least one railroad car in a string or trip of cars and moving the string a given distance along the railroad track. The car engaging members are most often mounted on sliding carriages situated and operated along an auxiliary indexer track or guideway juxtaposed to and in parallel relation to the railroad track in the fixed receiving facility. Fluid operated actuators such as hydraulic cylinders or chains moved by sprockets driven by hydraulic or electric motors supply power for moving the dogs and pulling the railroad cars. U.S. Pat. Nos. 4,006,691, issued to Kacir et al, and 4,354,792, issued to Cornish, show train positioners in the form of cable operated systems with horizontally disposed pulleys that approach the train from alongside the track and including an engaging member arm which engages a car coupler from above.

It is generally known to utilize dogs in the form of heavy vertically pivoting car-engaging arm members which are designed to engage and advance either the railway bogey wheel truck frame or an axle. The dogs are smaller than car coupler engaging arms and are carried by dog carriages which ride alongside on a dog carriage indexer track situated either between the rails of the railroad track to engage the axle or next to the railroad track to engage the bogey truck frame. Bogey frame-engaging dog systems may be further divided into two types. One type includes "low dogs" which are dogs that engage the lower portion of the truck frame below the axle; and the other employs "high dogs" which engage the frame at or above the height of the axles. One system using a horizontally disposed chain system to drive high dogs is described in U.S. Pat. No. 5,709,153 to Brandt, assigned to the same assignee as the present invention. That patent is deemed incorporated by reference herein for any purpose.

Most of these indexing systems require a relatively large amount of space alongside the track to accommodate elements,of the systems required to operate the vertically pivoting dogs which pop up to engage the bogey frames or axles of cars and are dropped for storage. They employ horizontal sprocket elements that are exposed to the elements and personnel in the vicinity. Also, many facilities for conducting unloading operations have been constructed with very little horizontal working space alongside the cars to accommodate bogey frame engaging systems. Accordingly, there exists a need for a horizontally compact train indexing system that can be effectively installed and operated in low clearance environments, in addition to a need for reducing the exposure of the moving mechanical elements of the system to the elements.

Accordingly, it is primary object of the present invention to provide a compact train positioning system that can be used in situations of close horizontal track clearance.

It is a further object of the present invention to provide a low clearance train positioning system that uses vertically operating dogs to engage the bogey frame of a car in conjunction with a over/under vertical disposed chain drive.

A still further object of the present invention is to provide a low clearance train positioning system that is a reversing system utilizing spaced opposed dogs.

Another object of the present invention is to provide a low clearance train positioning system that includes a top rail and lower chain tube enclosure.

Other objects and advantages associated with the present invention will reveal themselves or become apparent to those skilled in the art upon familiarization with the specification, drawings and claims contained herein.

SUMMARY OF THE INVENTION

The present invention provides a low clearance, compact guideway, train positioning system that can be installed in close quarters alongside an existing railroad track. The system is chain driven and features an improved over/under or vertical sprocket carriage drive system in which parts normally exposed to the elements are protected while, at the same time, horizontal space requirements alongside the track are reduced. The system employs a vertically oriented chain drive which employs enclosed vertically mounted drive and idler sprocket units and a chain tube enclosing the lower chain strand which further minimizes exposure of the mechanism chain to the elements by totally enclosing the lower chain path in the over/under arrangement. In this manner, the tendency of the mechanism including the chain and sprockets to accumulate foreign material and debris during and between uses causing wear and increased maintenance costs is averted.

The system is installed and operates closely alongside and parallel to the track using carriage-mounted, horizontally pivoting, bogey wheel frame-engaging high or low dogs that engage and advance railcars using successive car bogey frames in a well known manner. The dog carriage may be of a low profile, preferably not protruding more than a few inches above the level of the pivot mounting shafts for the dogs.

The train positioning or progressing system of the detailed description is a concurrent low dog designed to move a string of empty railcars and includes left and right low dog indexers or progressors which operate together to advance the cars as they reciprocate together along the tracks, alternating between a seeking/power or pulling mode and a redeploying mode. Of course, the arrangement of the invention may be used with any continuous chain drive system. The train positioning or progressing system may be designed to operate in a single direction or may be made reversing using spaced opposed dogs on separate carriages designed to collapse or raise in a conventional manner. The dogs are constructed to pivot or be locked down in the seeking mode (retracting direction) and pull or push the bogey wheel frame in the opposing direction during positioning. Construction and operation of the dogs is conventional and known to those skilled in the art. Reference is also made to the documents incorporated by reference herein.

The dog carriages of each indexer of the train positioning system of the present invention are spaced a fixed distance apart and slidably engaged in a dog carriage indexer track or guideway situated alongside and closely paralleling the railroad track. Each outer end of the spaced dog carriages is connected to a drive chain which meshes with a drive sprocket at one end of the indexer track and an idler pulley or sprocket at the other end of the indexer or track or guideway. The inner ends of the spaced dog carriages are connected together by a carriage-connecting chain and hydraulic tensioning cylinder which operates to keep the chain loop taut and the space between the carriages fixed. The drive sprocket is preferably aligned with the guideway and is generally powered by a prime mover, preferably a hydraulic motor. The hydraulic motors are operated together by a single combined hydraulic system to advance the drive chain to move the indexers in unison in either direction along the track.

Construction and operation of the dogs may be conventional and with respect to the detection of the presence of wheels and/or bogey frame on the cars of interest, of course, any compatible system may be employed. This includes proximity detection devices, optical beam systems and back deflection of the dogs themselves. Pull-down shafts and trippers may also be employed, together with proximity devices, noting carriage position, examples of which are shown in co-pending U.S. application Ser. No. 09/546,984, filed Apr. 11, 2000 and assigned to the same Assignee as the present application. This document is deemed incorporated herein by reference for any purpose.

BRIEF DESCRIPTION OF THE DRAWINGS

In the drawings wherein like numerals designate like parts throughout the same.

DETAILED DESCRIPTION

Figure 1:
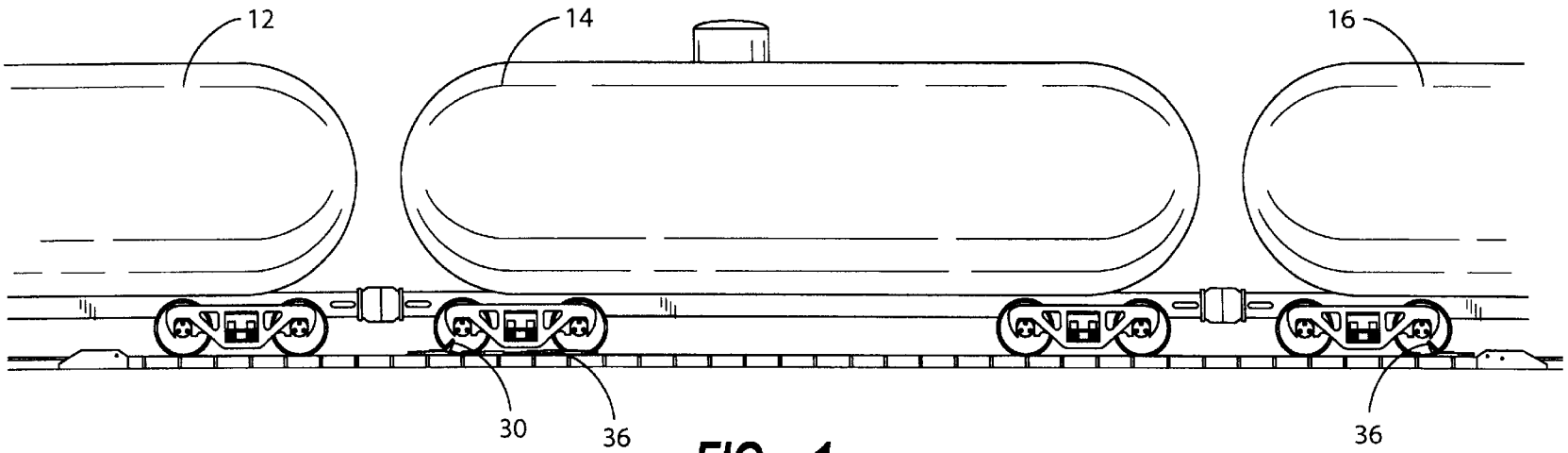
FIG. 1 is a fragmentary side view of a portion of a trip of cars and a reversing low dog indexer in accordance with the invention.

In accordance with aspects of the invention, it should be remembered that the detailed description contained herein is intended by way of example and not intended by way of limitation with respect to any aspect of the invention. The concepts of the invention can be used with any compatible chain drive indexing system. One advantage of the train positioning or indexing system of the invention is in retrofitting present railcar addressing facilities, particularly those which present inherent limitations with respect to available lateral trackside space. In addition, the unique drive arrangement enables the drive and idler sprockets and most of the chain to be enclosed thereby reducing or eliminating interference due to foreign material falling into the drive system and making the entire indexing device safer for those in the vicinity.

One embodiment of the train positioner of the present invention is depicted in the drawing figures. In FIG. 1A, a partial trip of cars 12, 14 and 16 is shown substantially centered with respect to an embodiment of the train positioning system of the invention. As shown in FIG. 2, the system includes left and right indexers or progressors pictured generally at 18 and 20, respectively, including respective dog carriages 22, 24 and 26, 28. The dog carriages 24 and 28 are also shown in the fully extended positions to illustrate the stroke length of the system. The illustrated system, as can be seen from the drawings, is one in which left and right indexers or progressors operate in unison. Such a system is of a type generally used for moving empty railcars using low bogey frame addressing dogs. Low dog indexers operating on lower bogey frames have a tendency to tip empty cars if only one side of the bogey frame is addressed at a time. This system is designed to push the bogey frame from opposite sides of the car simultaneously, thereby obviating such problems. The left and right indexers 18 and 20 further include drive motors 48 and 54.

The system may be one that reverses or one that operates in a single direction. In the detailed embodiment illustrated, the dog carriages are provided in spaced pairs 22, 24 and 26, 28. The dog carriage 22 is provided with a single forward facing low dog 30, dog tripper rod 32 and dog pull-down shaft 34. The dog carriage 24 includes a reverse facing low dog 36. Likewise, dog carriage 26, the opposite hand of dog carriage 22, is provided with forward facing low dog 38, dog tripper rod 40 and dog pull down shaft 42; and carriage 28, the opposite hand of carriage 24 is provided with a rearward facing low dog 44. The left unit addressing track 19 further includes a drive unit 46 with hydraulic motor 48 and an idler unit 50. The right unit associated with track 21 further includes drive unit 52 with hydraulic motor 54 and idler unit 56. Drive and idler unit details are shown in FIGS. 5A–5B and FIGS. 6A–6B.

Figure 2:
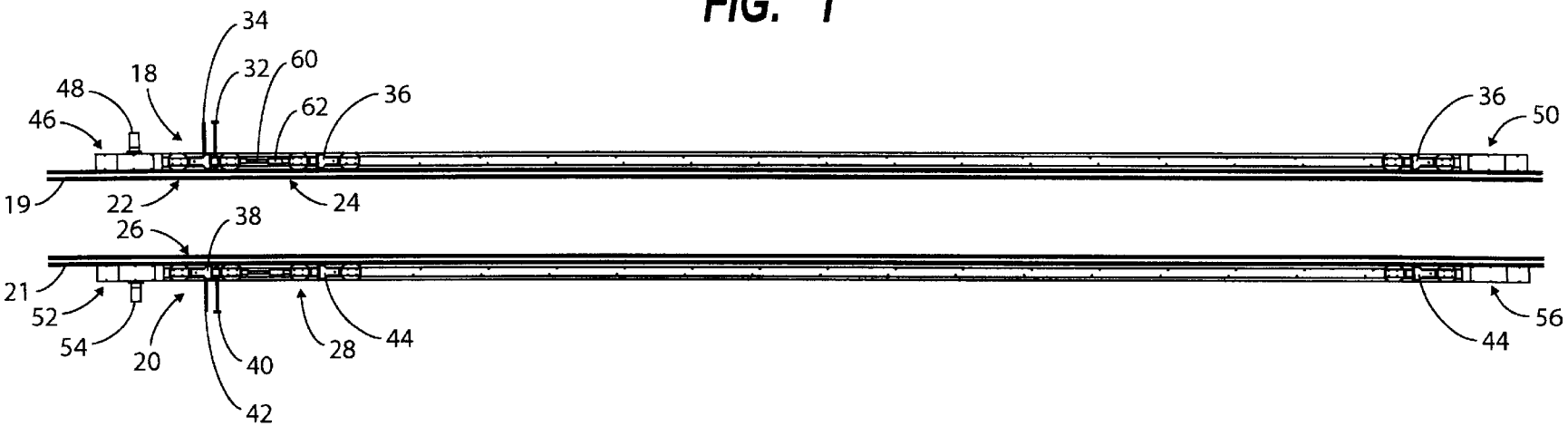
FIG. 2 is a plan view of the system layout shown in of FIG. 1.
Figure 3A:
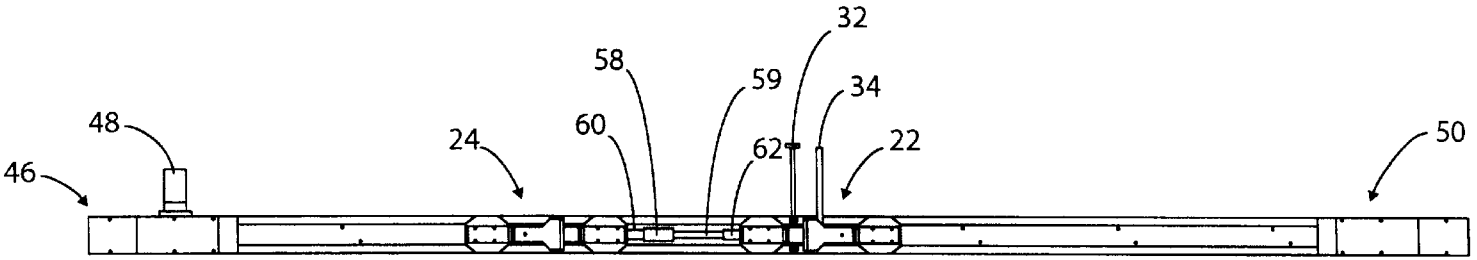
FIG. 3A is a top view of an indexer of a type similar to that of FIGS. 1 and 2.
Figure 3B:
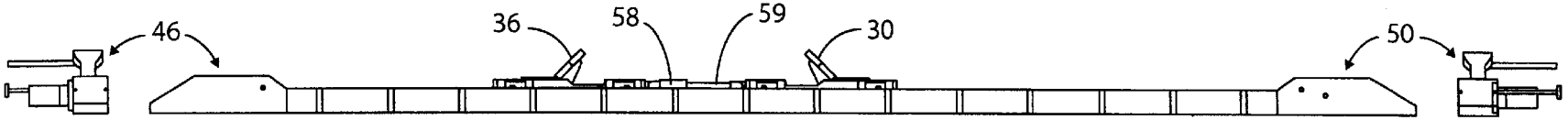
FIG. 3B includes a side and left and right end views of the indexer of FIG. 3A.
Figure 3C:
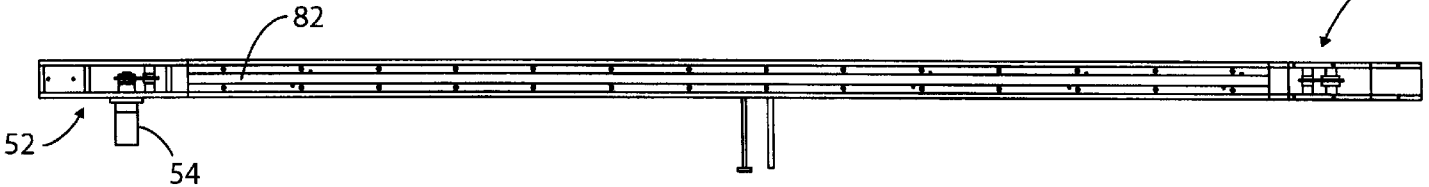
FIG. 3C is a top or plan view similar to FIG. 3A with the dog carriages and drive unit and idler unit cover plates removed.

FIGS. 3A–3C show an opposite hand arrangement of the positioning system of FIGS. 1 and 2. Inasmuch as the parts of the system are the same as those shown in FIGS. 1 and 2, the numbers for parts in FIGS. 3A–3C will be maintained as though the system were addressing tracks 19 and 21. This can better be seen in FIGS. 3A and 3B. The sets of carriages as at 22 and 24 operate in pairs and are maintained at a constant equal distance apart by a system including a chain-tensioning hydraulic cylinder 58 with rod 59 connected between connectors as at 60 and 62. The tensioning cylinder is a conventional manually operated cylinder having rod and blind ends connected between the carriages as at 22, 24. The cylinder may be provided with quick-disconnect fittings to accommodate a pumping handle to be attached and used as needed to adjust the cylinder extension. Retracting or collapsing the cylinder tightens the chain to increase tension on the system including the drive chain. This also maintains tension in the drive chain.

Figure 4:
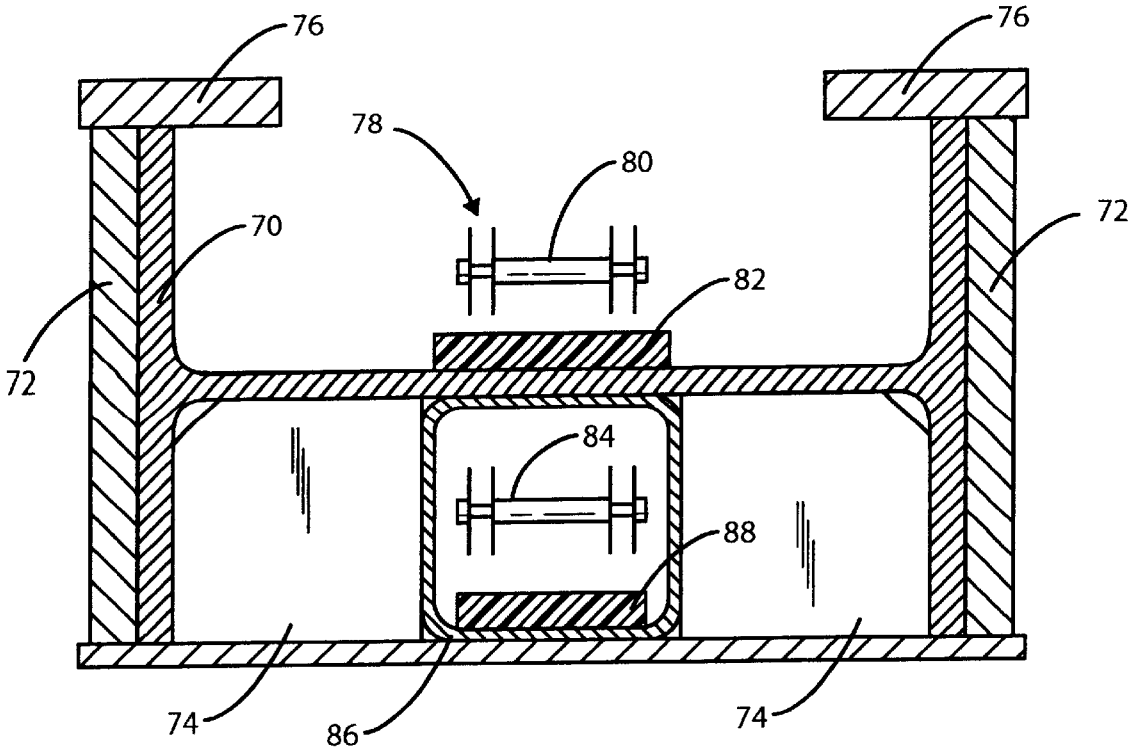
FIG. 4 is a greatly enlarged cross-sectional view through the dog carriage guideway depicting the beam and chain tube.

FIG. 4 depicts a cross section of a dog carriageway or guideway of the invention, including W-beam 70 reinforced by side gussets 72 and bottom gussets 74. Top rails for supporting the carriages are shown at 76. The continuous drive chain for driving the system is shown with an over/under arrangement at 78. The upper strand 80 (and carriage connecting chain) ride on a friction-reducing polymeric wear bar or pad 82 and the lower strand 84 rides in chain tube 86 fixed to the bottom of the center of W-beam 70 on another polymeric wear bar or pad 88. This system produces a very compact guideway for a positioning unit having a width which may be no more than about one foot and a height of about seven inches.

Figure 5A:
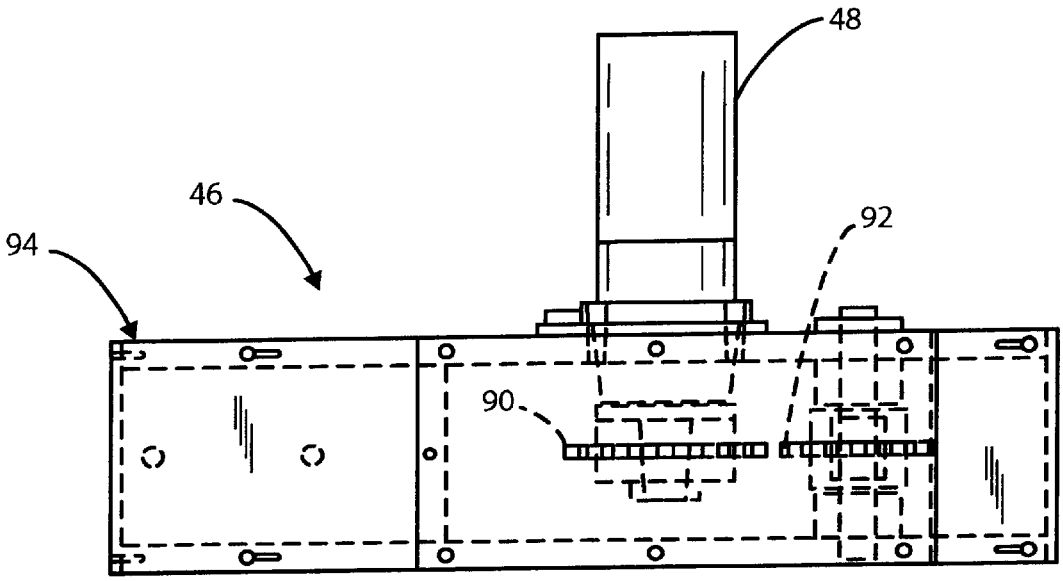
FIGS. 5A and 5B are, respectively, top and side views of an indexer drive unit in accordance with the invention.
Figure 5B:
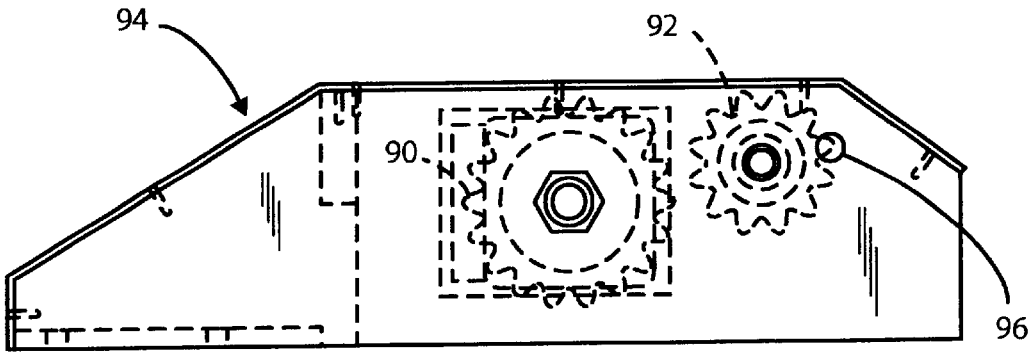
Figure 6A:
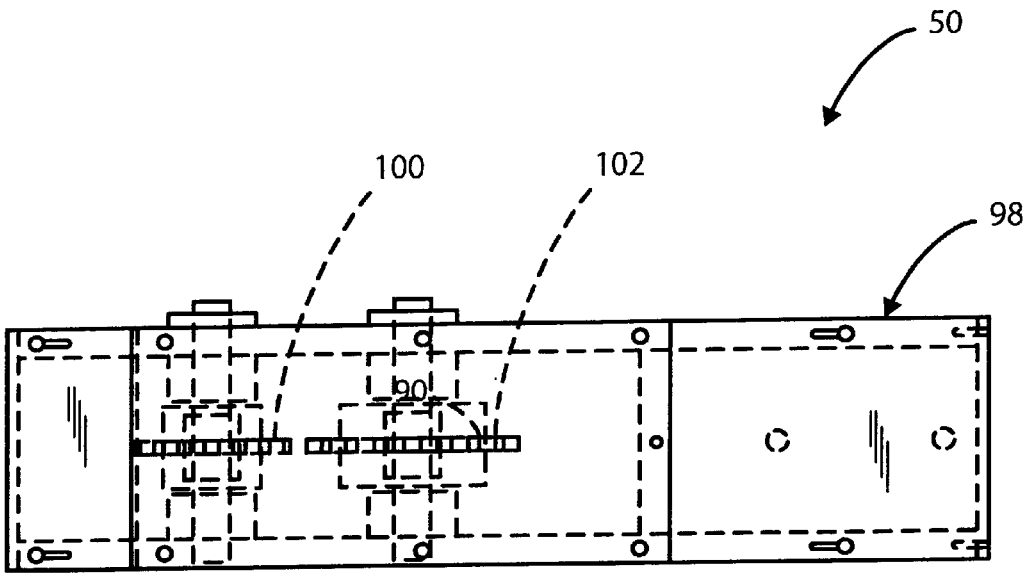
FIGS. 6A and 6B denote, respectively, top and side views of an indexer idler unit.
Figure 6B:
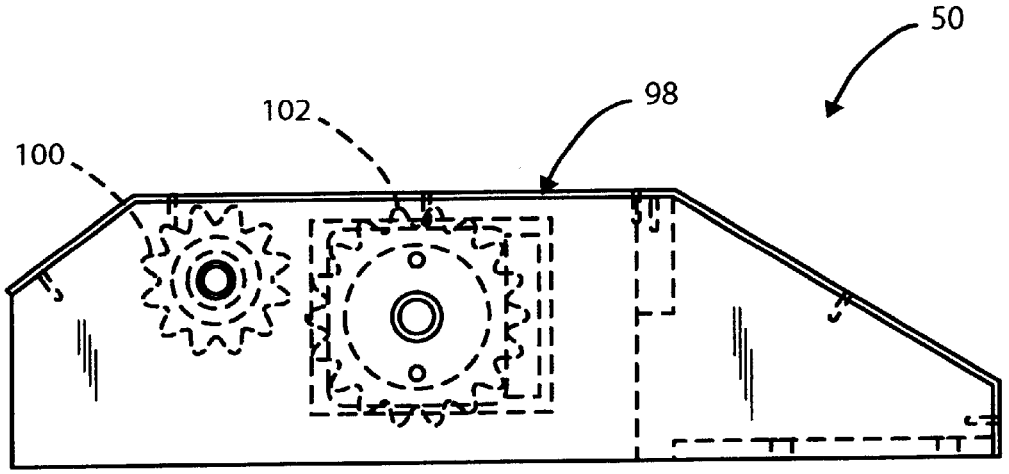

Details of a drive unit 46 and an idler unit 50 are depicted respectively in FIGS. 5A–5B and 6A–6B. As can be seen in FIGS. 5A and 5B, the output from motor 48 is direct connected to a main drive sprocket 90 aligned with drive unit idler sprocket 92 to drive a main drive as at chain 84 (FIG. 4) in either direction. The sprockets 90 and 92 are entirely enclosed in a drive unit housing 94 situated at one end of the progressor. Coordination between the opposite hand dog carriages with respect to the drive units is maintained by utilizing an optical tooth counter system (not shown) which counts the teeth of sprocket 92 through an opening 96 in the housing 94. Likewise, as seen in FIGS. 6A–6B, the idler unit 50 is enclosed in a housing 98 and contains aligned idler sprockets 100 and 102.

Figure 7:
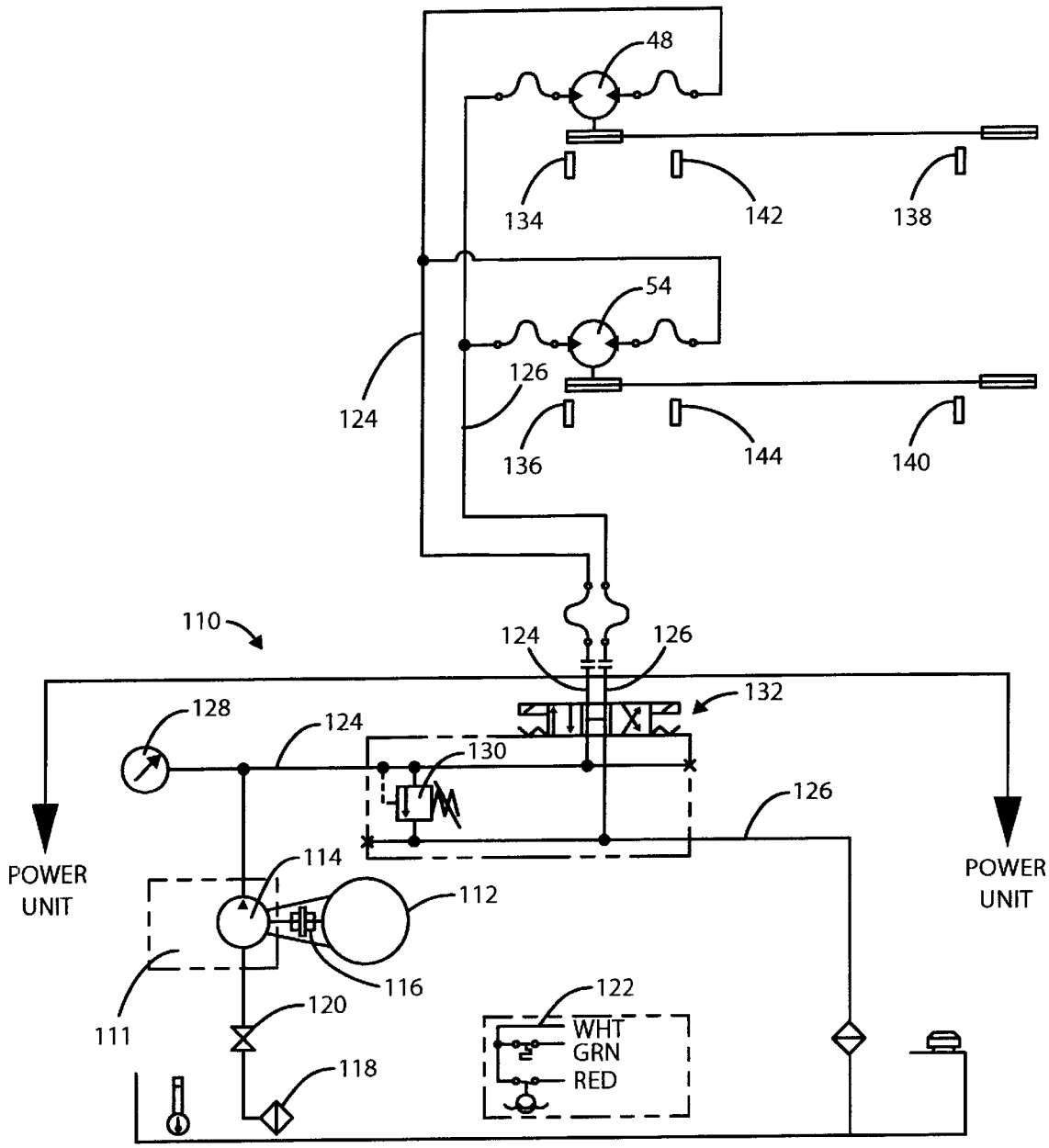
FIG. 7 is a schematic drawing of a power unit in the hydraulic system suitable for use with the indexer of the invention.

The power unit and hydraulic schematic for a system in accordance with the invention are shown in FIG. 7. The power unit is depicted at 110 and includes a fluid reservoir 111, electric motor 112 connected to drive a hydraulic pump 114 by a pump/motor coupling shown at 116. On the intake side of the pump, a magnetic sump strainer is shown at 118, a ball shut-off valve at 120 and a liquid level and temperature switch arrangement is depicted at 122.

The hydraulic pump 114 is connected via high pressure and return lines 124 and 126, respectively, to the indexer operating system and reservoir. A pressure gauge 128 and a pressure relief valve 130 are provided in line 124, the relief valve being connected to vent to the return line 126. A control valve 132 is used to control the forward and reverse operation of both the right and left indexers which are designed to operate simultaneously using parallel connected hydraulic motors 48 and 54 further coordinated using sprocket tooth counters 134 and 136, respectively. As shown in the figure, proximity switches 138 and 140 may be used to indicate the full stroke of the indexer in one direction and proximity switches 142 and 144 to indicate the stroke in the opposite direction.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For example, staggered indexers can be used to "hand off" and move trips of full cars or empty cars (using high dogs).

What is claimed is:

1. A compact indexer for a train positioning system for engaging in moving a railroad car or a trip of coupled cars, the indexer comprising:

(a) a dog carriage guideway juxtaposed and parallel to a railroad track and having first and second ends, a drive unit-enclosure at said first end and an idler unit enclosure at said second end;

(b) one or more dog carriages carried by and operable along said guideway;

(c) a drive unit including a generally vertically disposed drive sprocket mounted in and covered by said drive unit enclosure;

(d) an idler unit including one or more generally vertically disposed idler sprockets mounted in and covered by said idler unit enclosure;

(e) a drive chain connected to said one or more dog carriages and looped around said drive sprocket and said one or more idler sprockets connected to operate said one or more dog carriages along said guideway, said drive chain including said one or more connected dog carriages forming a continuous vertically disposed loop having upper and lower strands;

(f) a single support member carrying a friction-reducing wear bar in said dog carriage guideway for carrying said upper strand of said drive chain;

(g) a chain tube carried by said support member in said dog carriage guideway for enclosing and carrying said lower strand of said drive chain; and (h) a prime mover for rotating said drive sprocket.

2. An indexer for a train positioning system as in claim 1 wherein said support member includes a flanged W-beam for carrying said friction reducing polymeric wear bar and said chain tube, said guideway further including top rails fixed to said beam for supporting said one or more carriages.

3. An indexer for a train positioning system as in claim 2 wherein said prime mover is a direct connected hydraulic motor.

4. An indexer for a train positioning system as in claim 1 further comprising a pair of spaced dog carriages, oppositely disposed dogs carried by said pair of spaced dog carriages and means fixing a space between said pair of dog carriages.

5. An indexer for a train positioning system as in claim 1 further comprising a device for controlling tension in said chain.

6. An indexer for a train positioning system as in claim 4 further comprising a device for controlling tension in said chain.

7. An indexer for a train positioning system as in claim 5 wherein said device for controlling tension in said chain is a tensioning cylinder.

8. An indexer for a train positioning system as in claim 6 wherein said device for controlling tension in said chain is a tensioning cylinder.

9. An indexer for a train positioning system as in claim 8 wherein said space between said pair of dog carriages is controlled by said tensioning cylinder.

10. An indexer for a train positioning system as in claim 2 wherein said dog carriage guildeway has a width of one foot or less and a height of about seven inches.

* * * * *